US006712489B2

(12) United States Patent
Durkin

(10) Patent No.: US 6,712,489 B2
(45) Date of Patent: Mar. 30, 2004

(54) PORTABLE OUTDOOR LIGHTING FIXTURE

(76) Inventor: James M. Durkin, 334 Dawson St., Philadelphia, PA (US) 19128

( * ) Notice: Subject to any disclaimer, the term of this patent is extended or adjusted under 35 U.S.C. 154(b) by 0 days.

(21) Appl. No.: 10/082,401

(22) Filed: Feb. 26, 2002

(65) Prior Publication Data

US 2003/0161161 A1 Aug. 28, 2003

(51) Int. Cl.[7] ..... F21S 1/10; F21V 21/00

(52) U.S. Cl. ..... 362/358; 362/146; 362/183; 362/410; 362/413; 362/431; 248/122.1; 439/721

(58) Field of Search ..... 362/146, 183, 362/410, 413, 431, 358, 418, 411; 439/835, 441

(56) References Cited

U.S. PATENT DOCUMENTS 3,805,055 A * 4/1974 Cassey ..... 362/358
4,432,042 A * 2/1984 Zeller ..... 362/183
4,797,798 A * 1/1989 Schumaker et al. ..... 362/413
4,880,193 A * 11/1989 Warshawsky ..... 248/122.1
5,649,764 A * 7/1997 Strickland ..... 362/410
5,853,304 A * 12/1998 Landreau et al. ..... 439/721
6,505,950 B1 * 1/2003 Natoli et al. ..... 362/146

* cited by examiner

*Primary Examiner*—Sandra O'Shea
*Assistant Examiner*—James W Cranson, Jr
(74) *Attorney, Agent, or Firm*—Zachary T. Wobensmith, III

(57) ABSTRACT

A portable outdoor lighting fixture which includes a base with a post extending vertically therefrom with a telescoping tube therein with a compression nut to lock the tube at the desired height, with a flexible arm connecting the tube to a switchable shade assembly, and a low voltage transformer connected to a source of electrical energy and to a supply wire connected to a terminal block on the underside of the base of the fixture, and a wire connecting the terminal block to a switchable shade assembly.

5 Claims, 4 Drawing Sheets

PORTABLE OUTDOOR LIGHTING FIXTURE

BACKGROUND OF THE INVENTION

1. Field of the Invention

This invention relates to a portable outdoor lighting fixture, and more particularly to a fixture of the low voltage switchable type, that has the electric connections on the base of the fixture, and a low voltage supply remote from the fixture.

2. Description of the Prior Art

Various lighting fixtures have been proposed for outdoor use. These fixtures must be water resistant and not affected by sunlight. In addition, the fixture must be non corrosive, and must be safe, i.e. the consumer must be protected from electric shock regardless of the weather and other conditions under which the fixture is used, which is difficult to obtain with a conventional high voltage fixture, or a fixture which contains a low voltage transformer.

Various lighting fixtures have been proposed, such as those described in U.S. Pat. Nos. 480,749; 1,129,908; 2,732,487; 5,091,834; 5,649,760; 6,082,877; and U.S. Pat. No. 6,280,0645 B1, but none of them is wholly satisfactory.

This invention is directed to a portable low voltage outdoor lighting fixture, which is safe, is constructed of non corrosive materials, and is supplied with low voltage from a transformer remote from the fixture, with the low voltage connections in the base of the fixture.

SUMMARY OF THE INVENTION

This invention relates to a portable outdoor lighting fixture, of the low voltage type, constructed of non corrosive materials, and with the low voltage transformer remote from the fixture, and the electrical connections in the base of the fixture.

The principal object of the invention is to provide a portable low voltage outdoor lighting fixture.

A further object of the invention is to provide a fixture which has a shade that is capable of being fixed or flexible.

A further object of the invention is to provide a fixture that can have a weighted base, a spike for ground mounting, or can be attached directly to a deck, post or appliance.

A further object of the invention is to provide a fixture which is switchable.

A further object of the invention is to provide a fixture that is constructed of non-corrosive materials, and enjoys a long service life.

A further object of the invention is to provide a fixture which has a low voltage transformer remote from the fixture with the electrical connections in the base of the fixture.

A further object of the invention is to provide a fixture which has an adjustable arm, providing a variety of lamp shade fixture adjustments.

A further object of the invention is to provide a fixture which is adjustable for height.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
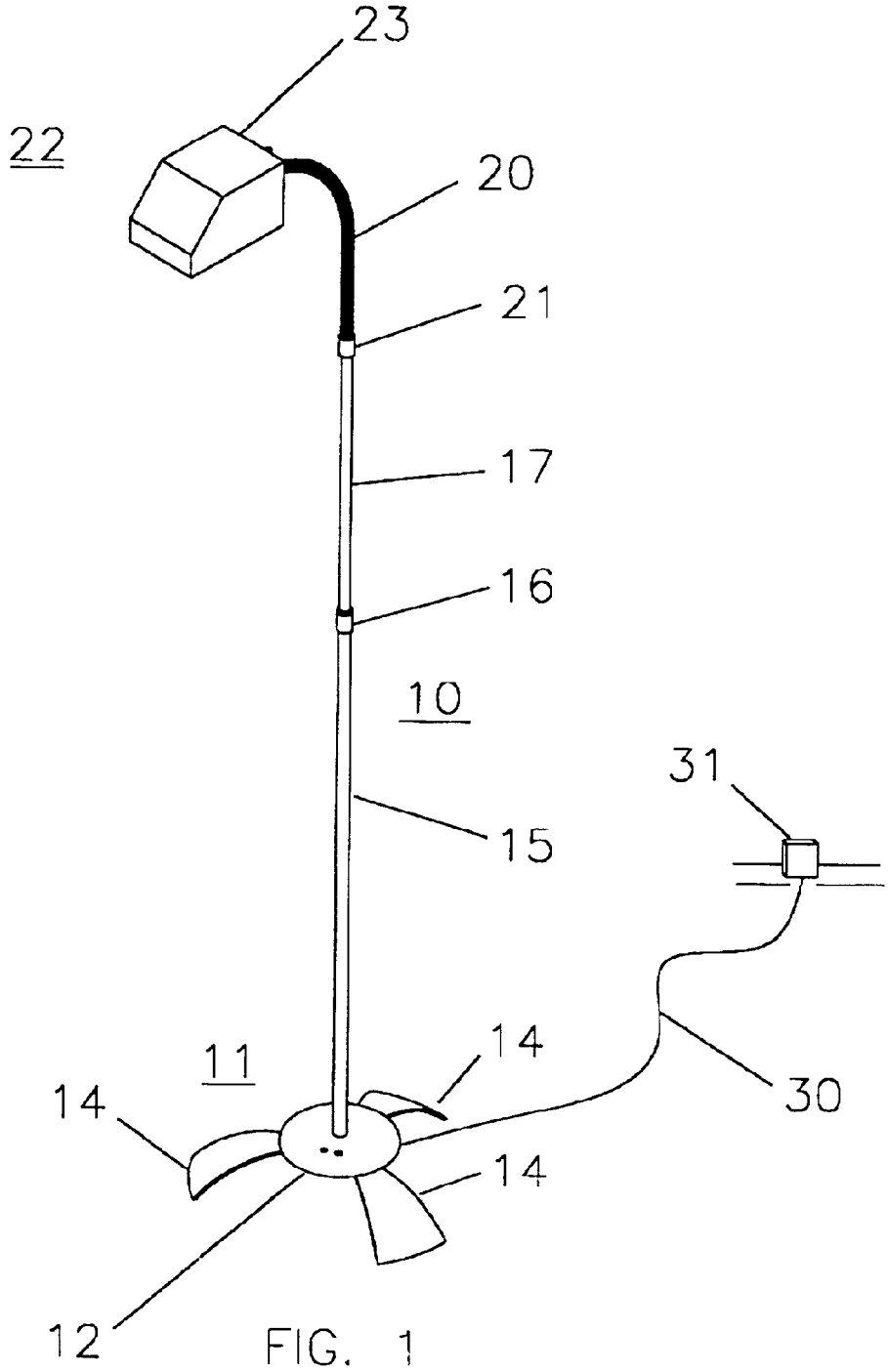
FIG. 1 is a perspective view of the portable outdoor lighting fixture of the invention.

It should, of course, be understood that the description and drawings herein are merely illustrative and that various modifications and changes can be made in the structures disclosed without departing from the spirit of the invention.

DESCRIPTION OF THE PREFERRED EMBODIMENTS

When referring to the preferred embodiments, certain terminology will be utilized for the sake of clarity. Use of such terminology is intended to encompass not only the described embodiments, but also technical equivalents which operate and function in substantially the same way to bring about the same result.

Referring now more particularly to the drawings and FIGS. 1–3, and 6 thereof, the portable lighting fixture 10 is therein illustrated. The fixture 10 includes a base 11, which has a center plate 12, with three curved leg portions 14 extending therefrom, and which may rest on the ground or other supporting surface (not shown). The plate 12 and legs 14 may be formed of any corrosion resistant metal, with stainless steel being preferred. If desired, a centrally located spike (not shown) may be substituted for the legs 14, which spike can be stuck into the ground. In addition, the plate 12 can be fastened to an appliance such as a gas grill (not shown) by brackets (not shown) or other well known fastening means.

A hollow pole 15 is provided, fastened to plate 12 and extending upwardly, with a compression nut 16 of well known type thereon, a hollow tube 17 is provided inside of pole 15 which can move upwardly or downwardly and is locked in position by a clutch or compression nut 16.

A hollow flexible arm 20 is provided, connected to tube 17 by fitting 21, with a shade assembly 22 connected thereto. The shade assembly 22, which is shown in more detail in FIG. 6, includes a switch 23 of well known type, which may be a push button, rotary, or toggle switch as desired, and which is water resistant. A bulb holder (not shown) and a low voltage bulb (not shown) are also carried in the shade assembly 22 with a wire 24 connected thereto, and extending in arm 20 through tube 17 and pole 15 to a terminal block 25 on the bottom of plate 12.

Figure 2:
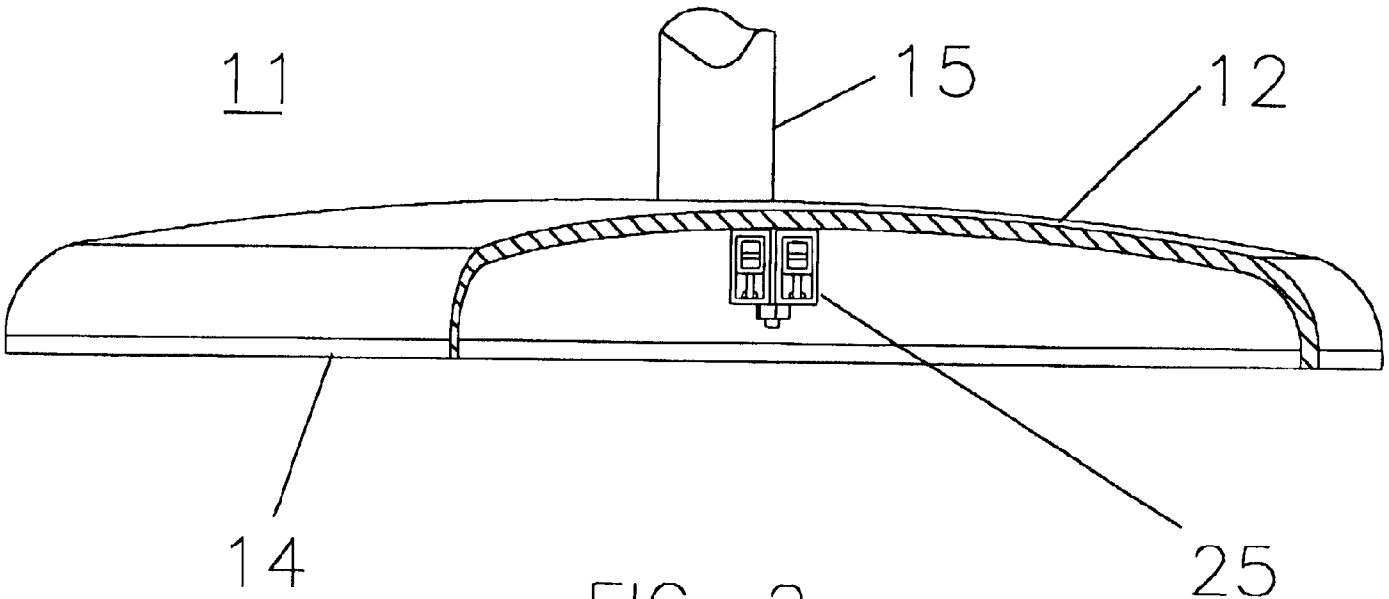
FIG. 2 is a fragmentary view, in partial section, of a portion of the base of the fixture showing one embodiment of electrical connection used with the fixture of the invention.
Figure 4:
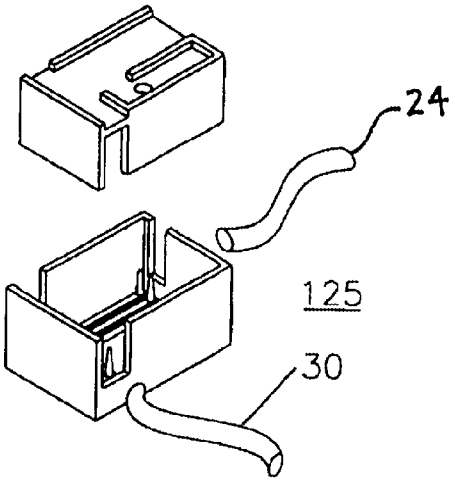
FIG. 4 is an exploded view of another connector block used with the fixture of the invention.
Figure 3:
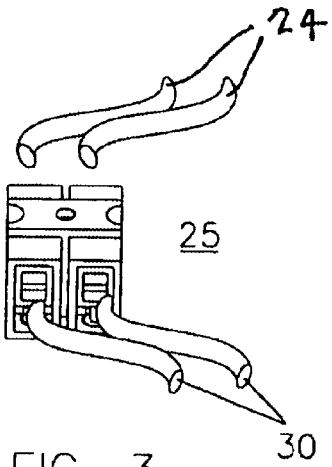
FIG. 3 is an elevational view of a terminal block used with the fixture of the invention.
Figure 5:
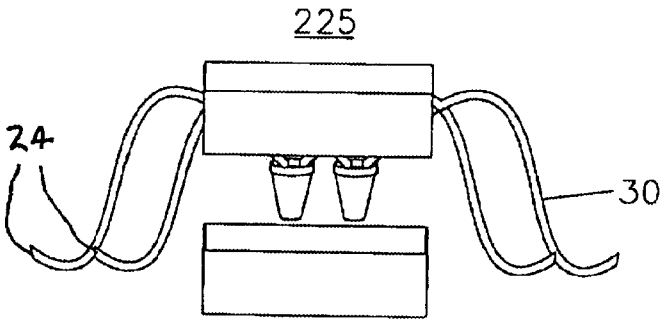
FIG. 5 is another embodiment of connector block used with the fixture of the invention.
Figure 6:
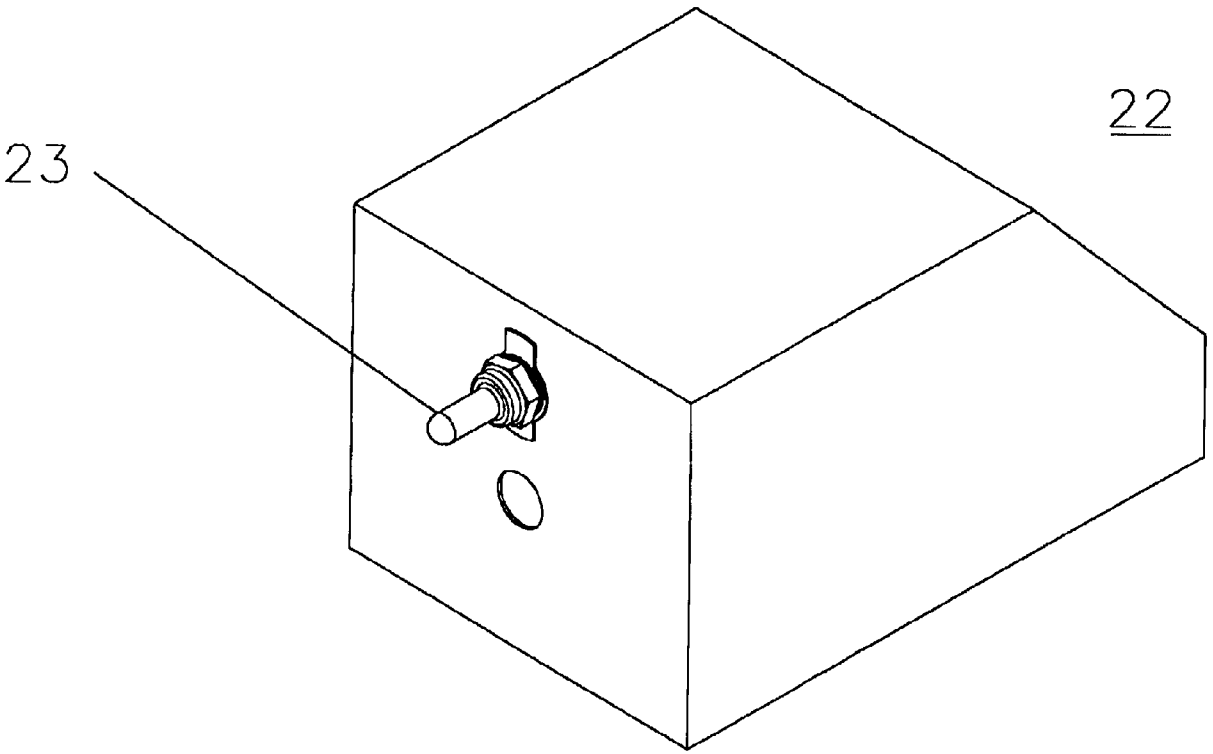
FIG. 6 is a view in perspective of a shade used with the fixture of the invention.

The terminal block 25 which is shown in FIG. 2 is a "Euro" style, which has a locking screw (not shown) engaged therewith and with a wire 30 attached thereto. The wire 30 extends to a low voltage transformer 31 of well known type, which is engaged in a 110 volt receptacle (not shown) on the wall of a house or other location, which receptacle is connected to a source of electrical energy (not shown). Referring to FIGS. 4 and 5 alternate electrical connector blocks 125 and 225 are illustrated respectively of the "vampire" and wire nut type, which are connected to the wire 30 and to the wire 24 which extends to shade assembly 22.

It will thus be seen that structure has been provided with which the objects of the invention are achieved.

What is claimed is:

1. A portable outdoor lighting fixture comprising;

base means, hollow pole means extending vertically from said base means, a flexible arm connected to said pole means, a shade assembly connected to said arm, said shade assembly including a low voltage bulb therein, said pole means includes a hollow pole connected to said plate, a tube in telescoped relation to said pole, and a compression nut onsaid pole to grip said tube to retain said shade assembly at a selected height, said base means including a base plate, at least three legs attached to said plate, a terminal connector block attached to said plate on the side opposite from said pole means, wire means connected to said block and to said shade assembly, said shade assembly includes a switch connected to said wire, and a low voltage transformer remote from said fixture connected to a source of electrical energy, and a supply wire connected to said transformer and to said connector block to supply low voltage to said fixture.

2. A lighting fixture as defined in claim 1 in which, said plate has a spike connected thereto to stick in the ground to provide support to said fixture.

3. A lighting fixture as defined in claim 1 in which, said terminal block has a plug connected to said low voltage supply wire and engaged in said block.

4. A lighting fixture as defined in claim 1 which, said wire means and said supply wire are engaged in said block.

5. A lighting fixture as defined in claim 1 in which, said wire means and supply wire are connected together in said block by wire nuts.

* * * * *